US007819060B2

(12) United States Patent
Taylor et al.

(10) Patent No.: US 7,819,060 B2
(45) Date of Patent: Oct. 26, 2010

(54) METHOD FOR MOUNTING CYLINDRICALLY-SHAPED PRINTING FORMS

(75) Inventors: Bradley K. Taylor, West Chester, PA (US); Stephan Riechert, Frankfurt (DE); Thies Knudsen, Offenbach/M. (DE)

(73) Assignee: E.I. du Pont de Nemours and Company, Wilmington, DE (US)

( * ) Notice: Subject to any disclaimer, the term of this patent is extended or adjusted under 35 U.S.C. 154(b) by 585 days.

(21) Appl. No.: 11/787,154

(22) Filed: Apr. 13, 2007

(65) Prior Publication Data

US 2008/0250960 A1 Oct. 16, 2008

(51) Int. Cl.
*B41L 3/02* (2006.01)
*B41L 3/08* (2006.01)
*B41F 13/10* (2006.01)

(52) U.S. Cl. ..... 101/486; 101/375; 101/DIG. 36

(58) Field of Classification Search ..... 101/485, 101/DIG. 36, 486, 216, 248, 375
See application file for complete search history.

(56) References Cited

U.S. PATENT DOCUMENTS 4,119,032 A * 10/1978 Hollis ..... 101/216
4,872,407 A 10/1989 Banke
5,331,893 A * 7/1994 Wieland ..... 101/486
5,439,328 A 8/1995 Haggerty et al.
5,551,339 A 9/1996 Schadlich et al.
5,685,226 A * 11/1997 Fuller ..... 101/415.1
5,701,822 A * 12/1997 Metrope ..... 101/477
5,778,779 A 7/1998 Jones et al.
5,819,657 A 10/1998 Rossini
5,850,789 A 12/1998 Rudolf et al.
6,312,872 B1 11/2001 Murphy et al.
6,472,121 B2 10/2002 Murphy et al.
6,571,708 B1 * 6/2003 Rudzewitz et al. ..... 101/477
6,691,613 B1 2/2004 Francille
7,290,488 B2 * 11/2007 Petersen et al. ..... 101/479
2003/0075257 A1 * 4/2003 Salvestro ..... 156/64

FOREIGN PATENT DOCUMENTS

EP 0 510 744 B1 12/1994
EP 1 060 884 A1 12/2000

* cited by examiner

*Primary Examiner*—Judy Nguyen
*Assistant Examiner*—Leo T Hinze
(74) *Attorney, Agent, or Firm*—Thomas H. Magee

(57) ABSTRACT

The invention provides a method and apparatus for mounting two or more cylindrically-shaped printing forms onto a cylindrically-shaped base. The base can be a print cylinder or an adapter mounted onto a print cylinder. The method and apparatus provide for positioning the two or more printing forms in register on the base. The two or more printing forms are axially oriented on the base using pressurized air as an air cushion between the base and the printing forms, positioned in a registration position, and engaged by a holding member to maintain the two or more printing forms in their respective registration position.

17 Claims, 2 Drawing Sheets

METHOD FOR MOUNTING CYLINDRICALLY-SHAPED PRINTING FORMS

BACKGROUND OF THE INVENTION

1. Field of the Disclosure

The invention pertains to a method and apparatus for mounting a printing form onto a cylindrically shaped base, and in particular the method and apparatus mounts a plurality of cylindrically shaped printing forms onto the base.

2. Description of Related Art

In relief printing processes a flexible printing form, usually in the shape of a plate, is mounted on a print cylinder of a printing press, inked, and then contacted to a substrate to print the desired pattern on the substrate.

Flexible printing plates are conventionally mounted on the print cylinder of a printing press by one of the following two methods in flexographic printing: (1) a carrier sheet, having one or more printing plates attached, is wrapped around the print cylinder; (2) one or more printing plates are directly mounted on the print cylinder, or onto a print sleeve that is mounted on the print cylinder. The plate or plates are attached securely to the carrier sheet or print cylinder using double-sided tape. However, in each method the plate or plates must be mounted accurately on the carrier sheet or print cylinder in order to assure registration of the printed image on the substrate.

The accurate positioning or registering of the flexible printing form on the surface of a printing cylinder has always been an important element in the attainment of quality printing. In particular, the accurate positioning or registration of each printing form on each cylinder is of paramount importance in a situation where multiple printing forms are required for the production of a multiple color finished product and where each color is applied to the product in a sequential manner by different forms on different cylinders. Registration errors give rise to superimposed colors, spaces with no color, color shifts, and/or degraded image detail.

The quality of a flexographic printing job depends, in large measure on the care with which prepress preparations are carried out. Plate mounting, color registration, and proofing can be conducted off the press by means of commercially available mounting-proofing machines designed for this purpose. These machines, which usually make use of an optical or video mounting system, make it possible to mount the plates on the plate cylinder to effect color registration, a procedure essential to the maintenance of both quality and economy in all flexographic operations.

However, flexible printing forms in the shape of plates may not be suitable for some printing jobs. Flexible printing forms that are cylindrically shaped, which may be referred to as continuous printing forms, sleeves, printing sleeves, or endless sleeves, have use in particular applications and provide certain advantages. Continuous cylindrically shaped printing forms have applications in the flexographic printing of continuous designs such as in wallpaper, decoration and gift wrapping paper, and tight-fit conditions for registration, since the designs can be easily printed without print-through of the plate seam. An alternative embodiment of a cylindrically-shaped printing form is sometimes referred to as a plate-on-sleeve, where one or more plates, or portions of a plate (sometimes called slugs) are mounted at various spaced locations on a cylindrically shaped support. The ends of a plate or a portion of a plate may or may not meet or join when wrapped onto the support. Such continuous printing forms and plate-on-sleeve forms are well-suited for mounting on laser exposure equipment where it can replace the drum or be mounted on the drum for exposure by a laser to achieve precise registration.

Continuous printing sleeves or cylindrically-shaped supports are generally mounted on a print cylinder by means of pressurized air that is injected at one end of the print cylinder and emerges through opening/s at an exterior surface of the print cylinder usually arranged angularly around the cylinder. This creates a cushion of air between the print cylinder and the continuous printing sleeve as the sleeve is mounted on the cylinder, which causes a slight radial expansion of the sleeve and allows the sleeve to move along and around the print cylinder. A single continuous printing form may be mounted in register on the print cylinder by a mounter-proofer unit as is done for plates. Once the sleeve is in position, the air is turned off so that the sleeve contracts and forms an interference fit with the print cylinder.

However, a problem arises in the case where more than one cylindrically shaped printing form will be mounted in register on the same print cylinder. A first cylindrically shaped printing form can easily be positioned in its registration position with the air cushion, and then retain the registration position when the printing form contracts with air turned off to the exterior surface of the print cylinder. However, the mounting of any additional cylindrically shaped printing form on the same print cylinder needs the air cushion to move the additional forms to registration position/s on the print cylinder. But the introduction of the air cushion can move the first printing form from its registration position. Thus, it is difficult to maintain registration of the first mounted (or any previously mounted) printing form while subsequently mounting any additional printing form/s on the same print cylinder.

Mechanical means have been devised to accommodate registration mounting of more than one cylindrically shaped printing form as disclosed in EP 0 510 744. EP 0 510 744 discloses an apparatus for mounting one or plurality of printing sleeves onto a printing roll core. The printing sleeves are mounted on the core from one end and are moved to a number of register positions on the core. The register positions include a number of registration means, such as pins, that project from an exterior surface of the core and cooperate with at least one recess in an edge of the sleeves. But the use of such mechanical pin means can be cumbersome and require modification of the printing cylinder to accommodate the mechanical registration pins.

Schadlich et al. in U.S. Pat. No. 5,551,339 disclose a process and device for register-correct positioning of a printing form sleeve on a printing cylinder at each print station of a rotary printing machine, each printing cylinder having a pressure gas cushion producible for moving the elastically-expandable printing form sleeve on the printing cylinder. At each print station, a printing form sleeve is placed on its respective printing cylinder without particular regard to its correct registration position. The position of the tightly (frictionally) fitted sleeve on the printing cylinder is determined by scanning the sleeve with a sensor to determine the registration markings relative to a register-correct position on the printing cylinder. The printing sleeve is released from its initially fitted position on the printing cylinder using the pressure gas cushion and held by a holding device. Then the printing cylinder is turned relative to the printing form sleeve (being held in position) by its angular deviation relative to its register-correct position. Subsequently the pressure gas cushion is turned off, and the printing form sleeve is again tightly fitted and set in its register-correct position relative to the printing cylinder. This method registers multicolor image produced by multiple printing stations each having a single printing form sleeve on a respective printing cylinder. However, the method does not acknowledge the problem associated with mounting in registration multiple printing form sleeves on the same printing cylinder.

Thus, it is important that each of more than one flexible cylindrically shaped print forms be mounted in register on a print cylinder. But the necessary presence of the air cushion to mount each additional cylindrical printing form on a print cylinder can change the position of the initially mounted cylindrical printing form out of registration on the cylinder. As such, it is difficult to maintain registration of the first mounted (or any previously mounted) printing form while subsequently mounting with an air cushion any additional printing form/s on the same print cylinder.

SUMMARY OF THE INVENTION

The present invention provides a method for mounting a plurality of cylindrically-shaped printing forms onto a cylindrically-shaped base. The base has an exterior surface and at least one opening for providing pressurized air to the exterior surface. The printing forms each have an alignment indicator and an interior surface capable of being radially expanded by the pressurized air, and an axial length such that the sum of the axial lengths of the printing forms is less than or equal to an axial length of the base. The method comprises:

a) axially orienting the interior surface of a first printing form adjacent the exterior surface of the base by expanding the first printing form with the pressurized air sufficiently to float the first printing form on the base;

b) positioning the first printing form on the base to a first registration position by aligning the indicator on the first printing form to the base;

c) engaging the floating first printing form with at least one holding member that maintains the first printing form in the first registration position;

d) axially orienting the interior surface of a second printing form adjacent the exterior surface of the base by expanding the second printing form with the pressurized air sufficiently to float the second printing form on the base;

e) positioning the second printing form on the base to a second registration position by aligning the indicator on the second printing form to the base;

f) engaging the floating second printing form to maintain the second printing form in the second registration position; and g) removing the pressurized air from the exterior surface of the base to allow the first and second printing forms to contract and thereby cause the respective interior surface of each printing form to contact the exterior surface of the base while the holding members maintain each printing form in the particular registration position on the base.

DESCRIPTION OF THE PREFERRED EMBODIMENT(S)

Figure 1:
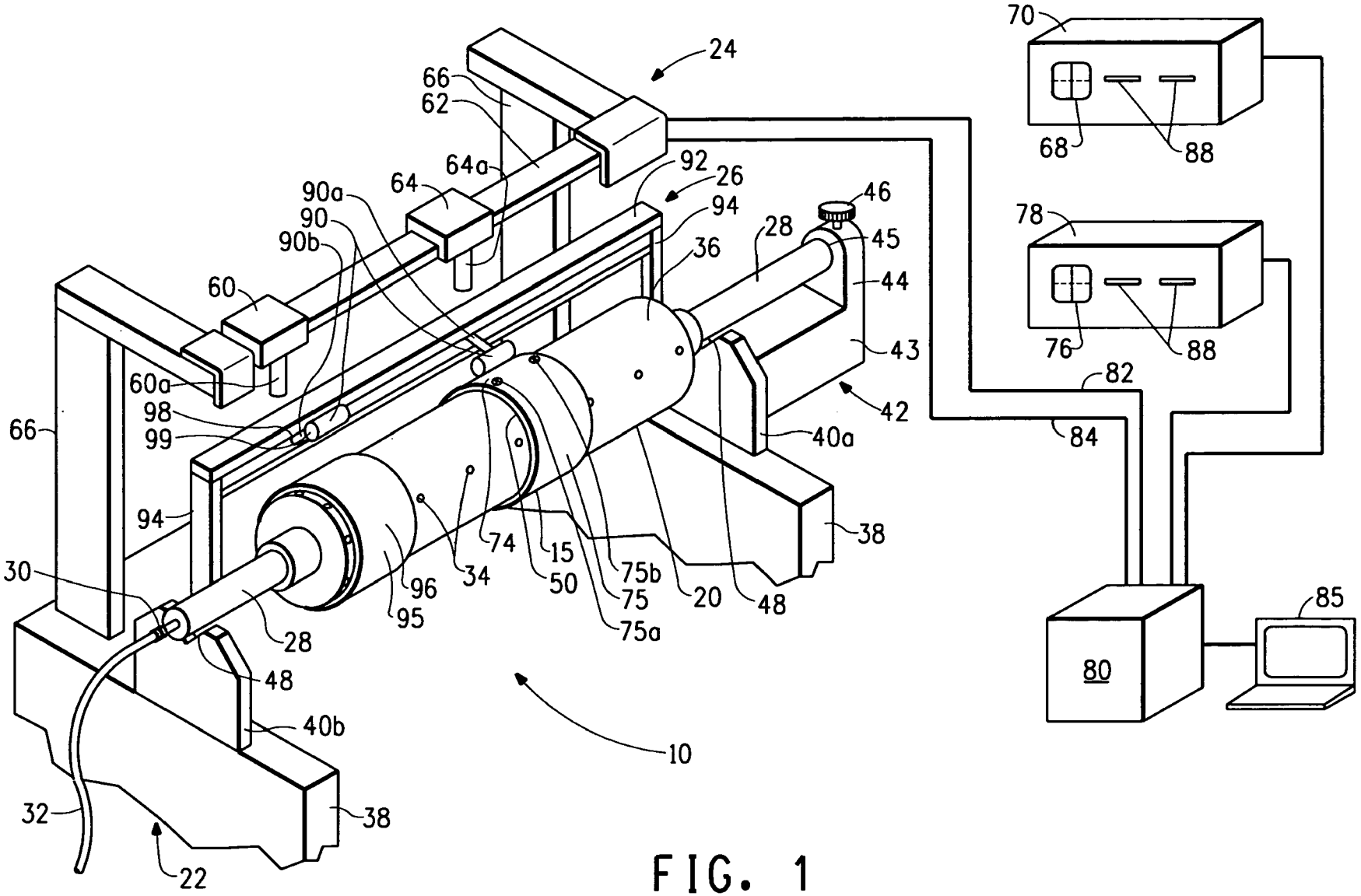
FIG. 1 is a perspective view of one embodiment of an apparatus for mounting at least one cylindrically-shaped printing form onto a base.

Throughout the following detailed description, similar reference characters refer to similar elements in all figures of the drawings.

The present invention provides a method and apparatus for mounting two or more printing forms onto a base. In particular, the method and the apparatus are for mounting two or more cylindrically-shaped printing forms onto a base that is cylindrically-shaped. The base can be a print cylinder or an adapter sleeve or adapter that mounts onto a print cylinder or a press mandrel for printing. The method and apparatus provides for positioning the two or more cylindrically-shaped printing forms in register on the base.

Printing forms for use in the present invention are not limited, provided that the printing form is cylindrically-shaped or can become cylindrically-shaped for mounting on the base. In one embodiment, the printing form can include a support and a layer of material having a relief structure suitable for relief printing, which includes flexographic printing and letterpress printing. In an alternate embodiment, the printing form can include photopolymerizable printing forms (precursors) in which a layer of a photopolymerizable material capable of forming a relief surface suitable for flexographic printing is included on the support. The support for the printing form itself may be cylindrical, or the printing form may be grouped with at least one other structure that is cylindrically-shaped. The cylindrically-shaped support or structure may also be referred to as a sleeve. The printing form can include one or more printing plates mounted onto a cylindrically-shaped support. The printing form includes at least one alignment indicator or registration mark for registering a position of the printing form on the base. In one embodiment, the printing form includes two alignment indicators or registration marks. The alignment indicator is not limited and can include, for example, any feature on a viewable surface of the printing form, a feature that is a part of the relief surface of the printing form, a feature embedded into or on the printing form, or a scribe mark or other marking on a surface of the printing form. The printing form includes a side edge at each end that may be considered an alignment indicator for positioning the printing form axially on the base. The printing form includes an exterior surface where typically the alignment indicator is located, and an interior surface that is adjacent or in contact with an exterior surface of the base. The printing form is capable of being radially expanded by a pressurized gas or fluid, and contracting when the pressurized gas or fluid is removed. The printing form has an axial length, which is an axis about which the printing form rotates. Each printing form mounted on a base has an axial length such that a sum of the axial lengths of all the printing forms (being mounted) is less than or equal to an axial length of the base. Printing forms having an axial length that is less than an axial length of the base may be referred to as mini sleeves. In one embodiment, the two or more printing forms may be positioned on the base such that one or more adjacent side edges of each printing form are abutting. In an alternate embodiment, the two or more printing forms may be positioned on the base such that there is a gap between the side edges of adjacent printing forms.

FIG. 1 shows one embodiment of an apparatus 10 for mounting two or more printing forms 15 in register onto a base 20. The apparatus 10 includes a means for supporting 22 the base 20, means for registering 24 the printing form 15, and means for engaging 26 the printing form. In this embodiment, the base 20 is a printing cylinder.

The print cylinder 20 includes a shaft 28 having a quick release connection nozzle 30 that can couple to a hose 32 connected to a source (not shown) of pressurized gas or fluid that provides gas/fluid to an interior chamber of the print cylinder 20. A valve (not shown) may be provided for opening and closing the connection to the air supply source. The print cylinder 20 includes a number of passages from the interior chamber to openings 34 on an exterior surface 36 of the print cylinder. The openings 34 provide the gas or fluid to the exterior surface 36 of the print cylinder 20 for mounting of the printing forms 15.

The apparatus 10 includes a frame and, as the means for supporting 22 the base 20, a base support assembly having vertical leg members 38 at opposite ends, and a shaft end rest 40*a*, 40*b* at each leg member. Attached to one of the shaft end rests 40*a* is a clamping assembly 42 for securely holding one end of the shaft 28 so that the printing cylinder 20 can cantilever for mounting of the printing forms 15. The clamping assembly 42 includes an extended platform 43 having an upright member 44 with a cavity 45 into which the end of the shaft 28 is inserted and secured in the cavity by a locking clamp 46. Securing the end of the shaft 28 is not limited to the embodiment shown in FIG. 1. Alternative embodiments for securing the end of the shaft 28 to cantilever in the apparatus are within the capabilities of those skilled in the art, and can include, for example, vises or other clamping systems. The other shaft end rest 40*b* rotates out of the position shown in FIG. 1 to allow access to an end of the printing cylinder 20 where the printing forms are mounted. The shaft 28 of the printing cylinder 20 resides in a recessed portion 48 of each of the shaft end rests 40*a*, 40*b*. The apparatus may also include a mechanism (not shown) for locking the base circumferentially in position and indexing the angular or rotational position of the base. The rests may also be slidable to accommodate bases of various widths (i.e., axial lengths). The base support assembly can be movable vertically to position the base adjacent to an optional proofing cylinder (not shown), or to bring the base into position for mounting and/or registration of the printing forms.

The base 20 has a shape that is cylindrical or substantially cylindrical. It should be understood that the base 20 can have ends that are slightly tapered or slightly stepped to aid in the mounting of the printing forms, and be considered substantially cylindrical. The base suitable for use is not limited and can include embodiments in which the base is a print cylinder, an adapter, an adapter sleeve, or an adapter (sleeve) for a print cylinder or press mandrel. The adapter can be hollow and can be positioned in the apparatus with, for example, a cone at each end of the adapter that is held in the vertical shaft supports. The adapter when mounted on a print cylinder increases the diameter and print circumference of the underlying print cylinder (or press mandrel). The adapter should be easily mountable and de-mountable from the print cylinder, and yet the adapter must be able to grip the underlying print cylinder without slippage on the underlying print cylinder during operations. The adapter may also be referred to as a bridge, bridge sleeve, adapter sleeve, or a repeat modifier. Also contemplated as an embodiment of the base is a drum, such as a drum used for supporting photosensitive elements in laser imaging devices.

The base 20 has an exterior surface 36 and one or more openings 34 for providing pressurized gas or fluid to the exterior surface. The pressurized gas or fluid is injected at an end of the base 20 and emerges through the openings 34 at the exterior surface 36 to cause a slight radial expansion of the printing form 15. The radial expansion of the printing form 15 creates a gap 49 between the exterior surface 36 of the base 20 and the interior surface 50 of the printing form 15 sufficient for the gas or fluid to fill between the exterior surface of the base and an interior surface of the printing form 15 and cushion the printing form. The cushion between the base 20 and the printing form 15 allows the printing form to move along and around the base for axial positioning and radial positioning to register the printing form relative to the base. Any pressurized fluid or gas is suitable for use provided that the gas or fluid is capable of expanding the printing form 15 sufficiently to allow the printing form to easily slide axially on the base 20. In a preferred embodiment the pressurized gas or fluid is pressurized air due to its ready availability. For simplicity, the pressurized fluid or gas supplied to the opening/s to the exterior surface 36 of the base 20 will be referred to herein as pressurized air or air.

In an embodiment where the adapter is mounted to a print cylinder, it may be desirable for both the underlying print cylinder and the adapter to have sufficient openings for the air on their respective exterior surfaces. Opening/s with air to the exterior surface of the print cylinder can be used to mount the adapter onto the print cylinder, similar to the mounting of printing forms onto the print cylinder. Opening/s with air to the exterior surface of the adapter (that resides on the print cylinder) is used to mount the two or more printing forms on the adapter. In one embodiment, the openings on the exterior surface of the print cylinder coincide with one or more channels or passages from an interior surface of the adapter to the openings on the exterior surface for the adapter. Alternate embodiments for providing pressurized air to the exterior surface of the base, and particularly the adapter as the base, is within the capabilities of those skilled in the art of mounting printing forms on print cylinders.

The number and position of the openings 34 on the base 20 are not limited, provided a sufficient number are located at appropriate positions on the base so that two or more printing forms can be mounted on the base. In one embodiment, the opening 34 can be located at an end of the base 20 where the printing form 15 is introduced for mounting on the base, that is, the mounting end of the base. In another embodiment, the base 20 may include a plurality of openings 34 circumferentially located at the mounting end. In another embodiment, the base 20 may include a plurality of openings 34 axially along its length. In this embodiment, the plurality of openings 34 can be spaced axially in accordance with the minimum width, i.e., axial length, of the printing form 15 intended for use on the base 20. The axial spacing of the openings 34 can be such that each printing form 15 being mounted on the base 20 covers at least one opening at any axial position across the base, and thus each of the printing forms is cushioned by the air and floating adjacent the base.

With a plurality of axial openings 34 on the base 20, it may be necessary to insure that the flow of air is sufficient or available to cushion a printing form 15 being mounted and float the printing form into position across or on the base. One technique to assure sufficient pressurized air flow to the openings is by manually covering the openings not needed for mounting each printing form as it is being mounted. In an alternate embodiment to assure sufficient pressurized air flow, each of the openings can include a spring-loaded ball valve in which the ball protrudes slightly above the exterior surface of the base. In this position, the ball blocks the flow of air to the exterior surface. When a printing form is moved onto the base, the printing form displaces the ball into the opening (away from the exterior surface) which allows air through the opening, and cushioning of the printing form. Another technique to assure sufficient air flow for orienting the printing form is to use a solid "push sleeve" to push the printing form into position to its axial position or to a position that is at least to close to its intended axial position. The push sleeve (not shown) has a length that can be approximately the length of the base so that the push sleeve will cover all of the openings that the printing form being mounted has already slid past. Optionally, an end of the push sleeve that contacts the printing form can have an edge shape to insure sufficient mechanical contact between the push sleeve and printing form.

Attached to the frame of the apparatus 10 is the means for registering 24 the printing form 15. FIG. 1 shows a registration assembly as one embodiment for the means for registering the printing form 24. The registration assembly includes a first camera assembly 60 adjacent to the base 20 and movably attached to a guide supporting member 62, and a second camera assembly 64 adjacent the base and moveably attached to the guide supporting member. The guide supporting member 62 is secured at its end to the frame by end supports 66 and at a level above the base 20 and parallel thereto. The first camera assembly 60 is connected to a first video monitor 68 in a first display unit 70 for viewing a first alignment indicator 75*a* on a printing form 15, and the second camera assembly 64 is connected to a second video-monitor 76 in a second display unit 78 for viewing an optional second alignment indicator 75*b* on the printing form. In one embodiment, the first and second video monitors 68,76 are connected, respectively, to the first and second camera assemblies 60,64 and via a motion controller 80. The apparatus 10 further includes means (not shown) connected to the first and second camera assemblies for independently moving each camera assembly on or along the guide support member 62 relative to the base 20. The motion controller 80 is also connected to the moving means for sending moving signals thereto, the motion controller generating at least two moving signals over lines 82, 84 corresponding to the alignment indicators 75*a*, 75*b* for each printing form 15. In one embodiment, the moving signals generated by the motion controller 80 may be controlled either from a preprogrammed memory card in the motion controller or from software program run by a computer 85 connected thereto. The moving signal directs the camera assembly 60, 64 to a respective location on the guide support member 62 adjacent the base 20 on which the printing form 15 is positioned in a registered location. In another embodiment particularly suited for multicolor printing, the motion controller 80 may be programmed to learn the desired registration position for each printing form while the printing forms for printing a first color ink are mounted on a first base. A person conducting the mounting method can determine arbitrarily or from experience suitable positions of each of the first color printing forms on the first base to establish respective registration positions. The lens of the camera assembly is aligned with the alignment indicator of each printing form being mounted on the first base, and the position of the camera assembly for the particular printing form is remembered by the motion controller or computer. The learned registration position of each of the mounted first color printing forms is then used to mount the printing forms corresponding to printing of a different color ink on a second base and subsequent bases.

Both the first and second camera assemblies 60, 64 each include a camera (not shown) and a camera lens 60*a*, 64*a*. The camera assemblies 60, 64 including the cameras and lens 60*a*, 64*a* are each mounted to a bracket connected to the guide supporting member 62 and oriented so that at least the lens are directed toward the base 20. The lens 60*a*, 64*a* of the camera focuses on the alignment indicator 75*a*, 75*b* on the printing form 15. Each camera assembly 60, 64 also includes a linear encoder, e.g., Anilam linear scales, connected to the motion controller 80 for measuring the precise position of each camera assembly. The base support assembly may include a rotary encoder (not shown) connected to the motion controller 80 for determining the index of the angular or rotational position of the base. The positions of each camera assembly 60, 64 (and the index position of the base) are transmitted from the motion controller 80 and displayed, respectively on the first and second display units 70, 78. The motion controller 80 can retain the position/s of the camera assemblies 60, 64 for each printing form 15. One or both of the camera assemblies 60, 64 can be used to determine the registration position of the printing form 15 relative to the base 20.

Optionally, the apparatus 10 may include a pre-registration light assembly (not shown) that includes a light focusing lens attached to a flexible fiber optic cable. The fiber optic cable is attached to a light source, such as a quartz halogen optic illuminator, located on the guide supporting member. The light focusing lens can be held in place by a clamp to the camera mounting bracket and is positioned to shine light on an area on the printing form directly beneath the lens and camera. The pre-registration light assembly illuminates the area on the printing form as well as the alignment indicator on the printing form.

Each display unit 70, 78 includes the video monitors 68, 76 that are connected to electronic cross-line generators (not shown) which produce on the video monitor screen 68, 76 a cross-hair image comprising vertical and horizontal lines. The intersection of the vertical and horizontal lines coincides precisely with the portion of the printing form 15, that is, the alignment indicator 75*a*, 75*b*, positioned directly beneath the camera lens 60*a*, 64*a*. The video cameras typically produce a 25× magnification of the target area of the printing form 15. The display units 70, 78 can also include numerical or digital displays 88 which read-out the position coordinates of the indicator.

The printing form 15 can be positioned manually on the base 20 to its axial position and/or its circumferential position, while the base remains fixed. Alternatively, the printing form 15 can be oriented to float on the base 20 and immobilized while the base is moved, axially and/or rotationally, to position the printing form in its registration position. It is also contemplated to combine manually positioning the printing form 15 and moving the base 20, to align the printing form to its registration position on the base. In one embodiment, the printing form 15 is positioned on the base 20 by moving the printing form axially to its axial position and rotating the printing form about the base to its circumferential position where the indicator 75*a* is aligned with the cross-hair image or according to position coordinates of the indicator. In many embodiments, the printing form is in its registration position, both axially and circumferentially, when the indicator is aligned with the cross-hair image or according to the position coordinates. In another embodiment, the printing form is positioned on the base by moving the printing form axially to its axial position, the indicator is aligned with the cross-hair image or according to the position coordinates and then the base is rotated to an index position to circumferentially position the printing form.

Rudolf et al. in U.S. Pat. No. 5,850,789 discloses one embodiment of a means for registering printing forms, in particular planar printing forms (plates), onto a print cylinder. Also, printing plate mounting devices are commercially available from various manufacturers including Microflex (Denmark), Bieffebi S.p.A. (Italy), J. M. Heaford Ltd. (UK), AV Flexologic b.v. (Netherlands), and E. L. Harley, Inc. (U.S.). It should be understood that one of ordinary skill in the art can modify the mounting apparatus disclosed by Rudolf et al. and other such commercial mounting-proofing apparatuses to accommodate the mounting of cylindrically-shaped printing forms. Alternate embodiments of the means for registering the printing form include, but are not limited to, optical spotting devices, for example, as disclosed by Banke in U.S. Pat. No. 4,872,407; reflection mounting devices as in disclosed in EP 015471; US 390633, U.S. Pat. No. 4,449,452.

Attached to the frame of the apparatus 10 is the means for engaging 26 the printing form 15. FIG. 1 shows one embodiment of a holding assembly as the means for engaging 26 the printing form. The holding assembly includes at least one holding member 90 movably mounted in a track member 92. In the embodiment shown in FIG. 1, the holding assembly includes at least two holding members 90 movably mounted in the track member 92. The holding member 90 can engage the printing form 15 to maintain the printing form in its registration position while the printing form is floating (from the air cushion). The holding member 90 moves along the track member 92, either manually or by a drive mechanism (not shown), to a position for engaging the printing form. The optional drive mechanism may be connected to the motion controller associated with the registration assembly, such that one or more of the holding members on the track can move according to registration information provided to the registration assembly. In one embodiment, the holding assembly includes at least two holding members 90 that are each independently movable on the track member 92. In general, the number of the holding members 90 on the track member 92 at least corresponds to the number of printing forms 15 intended for mounting on the base 15. In one embodiment, the number of holding members 90 on the track member 92 equals the number printing forms 15 being mounted on the base 20. In another embodiment, the number of holding members 90 on the track member 92 is one less than the number of printing forms 15 being mounted on the base 20. (In this case, a holding member, except for the last printing form being mounted, would engage each printing form being mounted. The last printing form can be held manually in registration position until the pressurized air is turned off.) In another embodiment, there are two or more holding members 90 on the track member 92 for each printing form 15 being mounted on the base 20. The track member 92 is located adjacent the base 20 and is secured at its ends to the frame by end supports 94. In FIG. 1, the track member 92 is located at a level above the base 20 and parallel thereto. In FIG. 1, a first printing form 75 and a second printing form 95 are positioned on the printing cylinder 20 in their respective registration position. A first holding member 90*a* is contacting an exterior surface 74 of the first printing form 75 thereby engaging and maintaining the floating first printing form 75 on the air cushion in its registration position. The second printing form 95 is positioned in its registration position and a second holding member 90*b* is adjacent an exterior surface 96 of the printing form 95 ready to be moved into engagement with the printing form 95 to maintain the floating printing form in its registration position.

Figure 2:
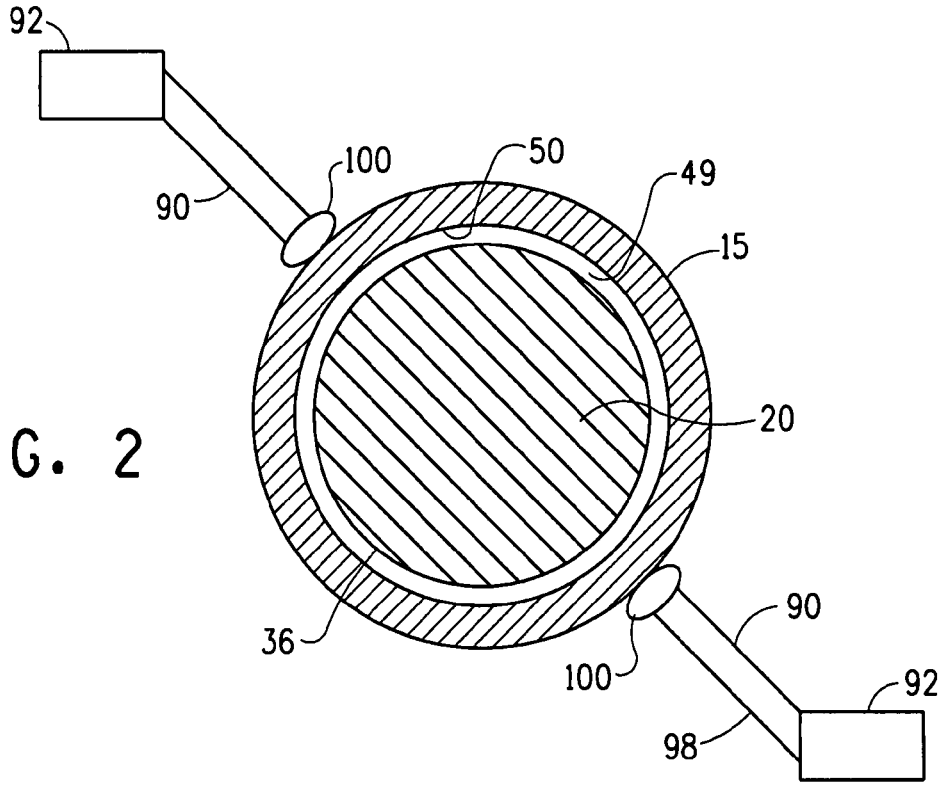
FIG. 2 is a cross-sectional view of one embodiment of a printing form axially oriented on a base and engaged by two of one embodiment of a holding member.

In one embodiment, the apparatus 10 may include a second holding assembly, which can be the same as, or substantially the same as, or different from, the holding assembly shown in FIG. 1. The second holding assembly may be located in the apparatus such that its holding members 90 on its respective track member 92 can be positioned substantially opposite the holding member 90 from the first holding assembly when the holding members are contacting or engaging the floating printing form as shown in FIG. 2.

In another embodiment, the apparatus 10 may include a second holding assembly and a third holding assembly. The second and third holding assemblies can be same as, substantially the same as or different from, the holding assembly shown in FIG. 1. The second holding assembly and third holding assembly may each be located in the apparatus 10 such that the holding members 90 on its respective track member 92 are positioned equidistant or substantially equidistant apart circumferentially on the exterior surface of the printing form 15 when the holding members are contacting the printing form as shown in FIG. 3.

It should be understood that the embodiments of the apparatus 10 having one, two, or three holding assemblies (holding means 26) are not limited to the particular embodiment shown for the holding member 90. The number of holding assemblies and the particular embodiment of the holding members can be mixed and matched differently from the embodiments shown in FIGS. 1 through 3, according to the capabilities needed for mounting printing forms on the apparatus. A holding assembly can include more than one embodiment of the holding members.

The structure of the holding member 90 is not particularly limited, provided that the holding member can engage or contact the printing form 15 and maintain the printing form in its registration position while the printing form is floating on the cushion of pressurized air. In a preferred embodiment, the holding member 90 engages the exterior surface of the printing form 15. In the embodiment shown in FIG. 1, the holding member 90 includes a rod 98 having one end that movably engages in or on the track member 92, and at the opposite end a roller 99 for engaging the floating printing form. Optionally, the end of the rod 98 that engages the track member 92 may be hinged so that the holding member 90 can be rotated from a non-engaging position to a position that engages the printing form 15. In the embodiment shown in FIG. 2, the holding member 90 includes a rod 98 having one end that moves in or on the track member 92, and at the opposite end a disk 100 for engaging the printing form 15 that is floating on the cushion of air. In another embodiment shown in FIG. 3, the holding member 90 includes a pneumatic piston rod 102 having one end that moves in or on the track member 92, and at the opposite end a projecting finger or tip 104 for contacting the exterior surface of the printing form 15 that is floating on the cushion of pressurized air. In addition to rollers, disks, and projecting fingers or tips, other suitable embodiments for a contacting member (i.e., the end of the holding member that contacts the printing form) include but are not limited to suction cups, shoes, flanges, clamps, probes, arcs, rings, etc. The end of the holding member that engages the printing form can be made of any suitable material that does not alter or disturb, or substantially alter or disturb, the contacted surface of the printing form. The holding member may contact the printing form with a force sufficient to maintain the registration position of the floating printing form. The holding member may contact the printing form on any exterior surface of the printing form. For example, for printing forms having a relief surface, the holding member may contact the printing form on an uppermost surface of the relief structure, i.e., printing or ink-carrying surface, or on a recessed surface of the relief structure, i.e., floor of the printing form.

Figure 3:
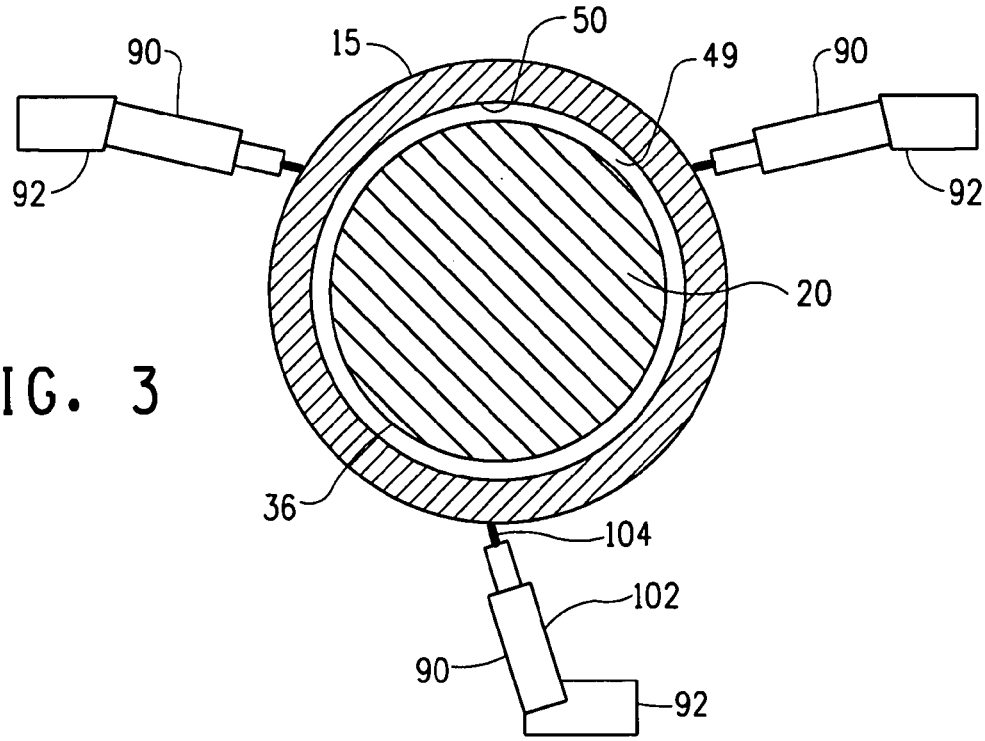
FIG. 3 is a cross-sectional view of one embodiment of a printing form axially oriented on a base and engaged by a plurality of another embodiment of a holding member.

Although the embodiments shown in FIGS. 2 and 3 depict the gap 49 as equidistant between the exterior surface 36 of the base 20 and the interior surface 50 of the printing form 15, it is contemplated that the gap 49 need not be equidistant between the base and the printing form, and still have accurate registration of the printing form. The gap 49 may have a different distance at each circumferential location. The gap 49 at for example, a location where the holding member 90 contacts the printing form 15, may be different (e.g., narrower) from the gap surrounding the remainder of the base, or may not be present at all (that is, the interior surface 50 of the printing form 15 may contact the exterior surface 36 of the base 20). A non-equidistant gap may occur in particular in embodiments having only one holding member to hold and maintain the registration position of the printing form. Factors such as the air pressure, the printing form being mounted, the holding member and its contacting method can influence the dimension of the gap and if the gap remains equidistant (after the holding member is contacting the printing form).

Method of Use

One embodiment of the operation of an apparatus for the method for mounting cylindrically-shaped printing forms onto a cylindrically-shaped base is described in reference to FIG. 1. The camera assemblies 60, 64 are turned on and information on the registration positions of each of the printing forms 75, 95 being mounted is entered to the computer. The base 20 is positioned in the apparatus 10 by placing the shaft 28 of the print cylinder in the recessed portion 48 of the shaft end rests 40*a*, 40*b*. The shaft 28 and/or base 20 may be rotated to set the base in the desired index (rotational) position in shaft end rests 40*a*, 40*b*. One end of the shaft 28 is located in the cavity 45 and locked into place with the locking clamp 46. A valve (not shown) is opened and pressurized air is injected from the hose 32 at end of the base 20 to flow out the one or more openings 34 on the exterior surface 36 of the base. One of the shaft end supports 40*b* is rotated out of position so that base 20 is cantilevered from one end of the shaft 28 and the opposite end is unfettered and available for mounting the printing forms 75, 95. The hose 32 for the supply of pressurized air may be disconnected at the quick release connection 30 in order to initially position a printing form 15 at the mounting end of the base 20.

A first printing form 75 is inserted on the mounting end of the print cylinder 20 covering one or more of the air openings 34 on the print cylinder, and axially orienting the interior surface 50 of the printing form 75 adjacent the exterior surface 36 of the print cylinder. The first printing form 75 expands with the pressurized air emitting from the openings 34 sufficiently to float the first printing form on the base 20. The first printing form 75 is positioned on the base 20 to a first registration position by aligning the indicator 75*a* on the printing form to the base. In one embodiment, the first camera assembly 60 moves along the guide support member 62 to a first axial position according to the signal sent by the motion controller 80, and focuses the lens 60*a* of the camera on the exterior surface 74 of the printing form 75. Optionally light from the pre-registration light assembly shines onto the printing form to aid in the registration step. The first printing form 75 that is floating on the air cushion is rotated about the base 20 until the alignment indicator 75*a* on the printing form displays on the video monitor 70 and is aligned with the crosshair display 68. If printing form includes a second alignment indicator 75*b*, the steps conducted by the first camera assembly are repeated using the second camera assembly 64 so that the second alignment indicator displays on the video monitor 78 and is aligned to the crosshair display 76. After the one or two alignment indicators 75*a*, 75*b* on the printing form 75 are aligned with each respective display, at least one holding member 90*a* moves along track member 92 adjacent the floating printing form 75, and the end 99 of the holding member is positioned to engage the exterior surface 74 of the printing form 75 and maintain the printing form in its registration position.

As described above, two or more holding members from the same assembly or from different holding member assemblies located circumferentially about the base may be used to engage and maintain the floating printing form in its registration position. In an alternate embodiment, the first printing form can be positioned axially on the length of the print cylinder by placing a side edge of the printing form at a specified distance from a side edge of the base. The camera assembly would be operated as described above to establish the rotational (or circumferential) position of the floating printing form relative to the base.

The same series of steps that are described above for positioning the first printing form 75 in its registration position are repeated to position a second printing form 95 (and any other subsequently mounted printing form) in its respective registration position. Since the holding member 90*a* is maintaining the first printing form 75 in its registration position, the camera assembly 60, 64 of the means for registering can be used to position the second (and subsequent) printing form 95 in its registration position. The second printing form 95 is inserted on the mounting end of the print cylinder 20 covering one or more of the air openings 34 on the print cylinder, and axially orienting the interior surface 50 of the printing form 95 adjacent the exterior surface 36 of the print cylinder. The second printing form 95 expands with the pressurized air emitting from the openings 34 sufficiently to float the second printing form on the base 20. The second printing form 95 is positioned on the base 20 to a second registration position by aligning an indicator on the printing form to the base. The first camera assembly 60 moves along the guide support member 62 to a first axial position according to the signal sent by the motion controller 80, and focuses the lens 60*a* of the camera on the exterior surface 96 of the second printing form 95. Optionally light from the pre-registration light assembly shines onto the printing form to aid in the registration step. The second printing form 95 that is floating on the air cushion is rotated about the base 20 until the alignment indicator on the second printing form displays on the video monitor 70 and is aligned with the crosshair display 68. After alignment indicator on the second printing form 95 is aligned with its respective display, at least one holding member 90*b* moves along track member 92 adjacent the floating printing form 95, and the end 99 of the holding member 90*b* is positioned to engage the exterior surface 96 of the second printing form 95 and maintain the printing form in its registration position.

Once two or more of the floating printing forms 75, 95 are in their respective registration position and engaged by at least one holding member 90*a*, 90*b* to maintain the floating printing forms in their position, the pressurized air supply valve is closed and air no longer emits from the openings on the base. Removing the pressurized air from the exterior surface of the base allows the at least two floating printing forms 75, 95 to contract and cause the respective interior surface of each printing form to contact the exterior surface 36 of the base 20. The holding members can continue to maintain each printing form in its particular registration position on the base when the printing form contracts. Contraction of the printing form causes an interference fit of the printing form with the base.

In an alternate embodiment of the method, the steps described above can be carried out in the same or substantially the same way as the method described above, except that the order that the steps are conducted may be different. In this embodiment, two or more of the printing forms will be first sequentially axially oriented on the base allowing all the printing forms to freely float on the base. Then in sequence, each floating printing form is positioned axially and rotationally in its respective registration position and engaged by the at least one holding member to maintain the printing form in its registration position relative to the base. After two or more of the printing forms are positioned it their respective registration position, the pressurized air is removed from the exterior surface of the base and the printing forms contract to contact the base.

The present method and apparatus provides for mounting two or more cylindrically shaped printing forms in register on a cylindrical base. The method and apparatus maintains registration position of a first mounted (or any previously mounted) printing form while subsequently mounting any additional printing form/s on the same print cylinder. The method is relatively quick and easy while providing accurate registration positioning of the printing forms on the base. Advantageously, the method and apparatus uses conventional print cylinders requiring no special modifications or tooling (e.g., pins), and readily available pressurized air with conventional sleeve mounting methods, to mount in register a plurality of printing forms on the same base. The capability of printing with more than one printing form on the base can provide advantages to the printer in increased printing capacity and versatility. Using two or more printing forms on the same print cylinder enables coverage of print cylinders that are larger (axial length) than the printing forms. Use of two or more cylindrical printing forms on the same print cylinder can also enable arbitrary positioning of image content of one printing form with respect to the other printing form/s at the time of mounting. Two or more cylindrical printing forms on the same print cylinder can also enable reuse and arbitrary repositioning based on image content, including mixing the cylindrical printing forms in different combinations.

Printing Form

The printing form is not limited and can include printing forms suitable for use in relief printing, for example, flexographic printing and letterpress printing; and in gravure printing. In one embodiment, the printing form may originate from a non-photosensitive printing form, such as a printing form made of natural rubber or synthetic rubber. In another embodiment, the printing form is or originates from a photosensitive printing form that typically includes a support and a layer of a photosensitive material capable of forming a relief suitable for printing. In one embodiment, the photosensitive printing form is a photopolymerizable printing form. In another embodiment, the printing form can include a support and a layer of material having a relief structure suitable for relief printing, so-called polymeric relief printing forms or elastomeric relief printing forms.

Since the printing form is mounted onto the cylindrically shaped base, in many embodiments the shape of the support is cylindrical. The cylindrically-shaped support or structure may also be referred to as a sleeve. The printing form may include a continuous, seamless or substantially seamless, photopolymerizable composition layer adjacent to or on the cylindrically-shaped support. The printing form can also encompass a plate-on-sleeve system. Typically, plate-on-sleeve is a photosensitive element that includes at least the composition layer on a planar support, i.e., a plate, which is then mounted onto a cylindrically-shaped support. Ends of the plate may or may not meet or join when wrapped onto the sleeve. Plate-on-sleeve also includes an embodiment in which more than one plate, or portions of plates, are mounted onto a sleeve at various spaced locations. Also contemplated as the printing form is a photosensitive plate having at least one photopolymerizable composition layer preferably on a base support, which is formed into a cylinder by butt joining both edges. The plate edges can be joined by any method including, but not limited to, melt fusing, taping, stitching, clamping, stapling, taping, gluing, and sewing. To the extent that the plate edges can be joined in such a way as to allow the form to float or move along the air cushion of base, this embodiment is suitable for use in the present invention. In many embodiments, the printing form originates from the photopolymerizable printing form that has undergone steps to form a relief structure suitable for printing. Any of the embodiments for the cylindrically shaped printing form described above may be referred to as, printing forms, continuous printing forms, cylindrical photosensitive elements, or cylindrical printing forms.

In order for the printing form to be readily mounted onto the base, the support can be a hollow cylinder typically having a uniform inner diameter, or the printing form can be formed into a cylinder. The printing form is expandable and contractible since it readily and repeatably mounts and dismounts from printing cylinders. The printing form must be able to grip the print cylinder without slippage, i.e., elastically expandable diametrically. Typically, the printing form has an interference fit with the base of less than 1 mil up to about 15 mils. Suitable interference fit can differ based on the printing form. The printing form should be expandable with the 20 to 130 psi air generally available in printing facilities and should expand sufficiently so they are easily slid over the base, so that an expansion exceeding the amount of interference fit is required.

The support for the printing form, i.e., sleeve, can be made of any material which is conventionally used as a support for photosensitive elements for printing. Examples of suitable support materials include polymeric films, such as those formed by addition polymers and linear condensation polymers, and foams and fabrics, such as fiberglass. Other materials suitable for use as a sleeve include polystyrene and polyvinyl resins, such as polyvinyl chloride and polyvinyl acetate. The present method is useful for sleeves made of polymeric films. A preferred polymeric film for a sleeve is polyester film, particularly polyethylene terephthalate (PET). Other linear, crystalline polyester films can also serve as base film substrate. Sleeves made of polymeric films are preferred, as they typically are transparent to ultraviolet radiation and thereby accommodate backflash exposure for building a floor in the cylindrical printing element. The sleeve may be formed from a single layer or multiple layers of material provided that the sleeve has the above-described characteristics. Multiple layered sleeves may include an adhesive layer or tape between the layers of flexible material. An example of a multiple layered sleeve as disclosed in U.S. Pat. No. 5,301,610. The sleeve support may include one or more cushion layers, one or more reinforcing layers, one or more compressible layers, and combinations thereof. The cushion layer, reinforcing layer, and/or compressible layer may form an interior and/or exterior surface layer of the sleeve. Other examples of sleeves suitable for use in the photosensitive element are disclosed by Bass et al. in U.S. Pat. No. 3,146,709 and by Hoage et al. in U.S. Pat. No. 4,903,597. The sleeve or support may also be made of non-transparent, actinic radiation blocking materials, such as metals, e.g., nickel, aluminum, steel; or composites, e.g., glass epoxy. The support for photosensitive elements (for use as plates-on-sleeves) is typically between 0.002 to 0.015 in (0.005 to 0.038 cm). The sleeve has a wall thickness that can vary over a wide range depending upon the type of printing form desired, for example, from about 0.002 inch to about 1 inch or greater (0.005 to 2.54 cm or greater). Typical wall thickness for so-called thin sleeves can range between 0.005 to 0.025 inch (0.013 to 0.64 cm). Typical wall thickness for fiberglass-based sleeves can range between 0.010 to 0.050 inch (0.025 to 0.127 cm). Typical wall thickness for multilayer composite sleeves can range between 0.040 to 1 inch or greater (0.10 to 2.54 cm or greater). In one embodiment, the sleeve has a wall thickness from 0.010 to 0.080 inch (0.025 to 0.203 cm). In another embodiment, the sleeve has a wall thickness from 0.010 to 0.040 inch (0.025 to 0.10 cm).

The sleeve has an outer surface which may optionally bear a subbing layer of an adhesive material or primer to facilitate the adherence of the photopolymerizable layer to the sleeve. In addition, the outer surface of the sleeve may be flame treated or electron treated, e.g., corona treated. The treatment or primer layer is particularly useful when the sleeve is formed of a polymeric film.

The preparation and formation of cylindrical seamless or substantially seamless printing forms is not limited, and may be prepared for example, according to the methods and apparatuses disclosed by Cushner et al. in U.S. Pat. Nos. 5,798,019 and 5,916,403; Arimatsu in U.S. Pat. No. 4,337,220; Kitamura et al. in U.S. Pat. No. 4,868,090; Koch et al. in U.S. Pat. No. 4,869,997; Wallbillich et al. in U.S. Pat. Nos. 4,871,650 and 4,883,742; Fan et al. in U.S. Pat. No. 6,425,327; and Rossini et al. in U.S. Publication No. US 2002/0069777 A1. An example of a seamless photopolymerizable printing form is disclosed by Fan et al. in EP 0 766 142 A1.

The layer of the photosensitive composition on the support is preferably a photopolymerizable layer of an elastomeric composition wherein the photosensitive layer can be selectively cured by actinic radiation. As used herein, the term "photopolymerizable" encompasses systems which are photopolymerizable, photocrosslinkable, or both.

All compositions of photopolymerizable materials of the state of the art can be used to create the printing form. Photopolymerizable compositions usually comprise at least one elastomeric binder, at least one photopolymerizable, ethylenically unsaturated monomer, and at least one photoinitiator or photoinitiator system.

Examples of elastomeric binders are polyalkadienes, alkadiene/acrylonitrile copolymers; ethylene/propylene/alkadiene copolymers; ethylene/(meth)acrylic acid((meth)acrylate copolymers; and thermoplastic, elastomeric block copolymers of styrene, butadiene, or isoprene. Linear and radial thermoplastic, elastomeric block copolymers of styrene and butadiene or isoprene are preferred. The quantity of binder is preferably 65% by weight, relative to the total weight of the photopolymerizable material. Other suitable photosensitive elastomers that may be used include polyurethane elastomers, such as those described in U.S. Pat. Nos. 5,015,556 and 5,175,072.

Useful monomers are the conventional ethylenically unsaturated, copolymerizable, organic compounds, such as, for example, acrylates and methacrylates of monovalent or polyvalent alcohols; (meth)acrylamides; vinyl ethers and vinyl esters; etc., and mixtures of such compounds. The monomer quantity is preferably at least 5% by weight, relative to the total weight of the photopolymerizable material.

Suitable photoinitiators are individual photoinitiators or photoinitiator systems, such as, for example, benzoin derivatives, benzil acetals, diarylphosphine oxides, etc., also mixed with triphenyl phosphine, tertiary amines, etc. The quantity of photoinitiator is usually 0.001-10% by weight, relative to the total weight of the photopolymerizable material.

In addition to the main components described in the foregoing, the photopolymerizable compositions may comprise conventional additives like, for example, UV absorbers, antioxidants, antiozonants, thermal stabilizers, processing aids, plasticizers, and fillers. Especially preferred are the materials disclosed in U.S. Pat. Nos. 4,323,637; 4,427,759; and 4,894,315.

As is conventional in the art, the photosensitive element may include one or more other layers on the photosensitive layer on the side opposite the flexible substrate. Other layers on the photosensitive layer include release layer, elastomeric capping layer, barrier layers, radiation-opaque layer, and an infrared-sensitive layer and combinations thereof. One or more of the additional other layers can cover or only partially cover the photosensitive layer. Suitable compositions for the elastomeric capping layer and methods for forming the layer on the element are disclosed as elastomeric compositions in a multilayer cover element described in Gruetzmacher et al., U.S. Pat. Nos. 4,427,759 and 4,460,675. The infrared-sensitive layer can be on the photosensitive layer, or on a barrier layer which is on the photosensitive layer, or on another support which together with the photosensitive element form an assemblage. The infrared-sensitive layer is substantially opaque to actinic radiation (e.g., has an optical density of $\geqq 2.5$) and can be imaged with infrared laser radiation. The infrared-sensitive layer can be ablated (i.e., vaporized or removed) from the photosensitive layer on the side opposite the support by exposure to infrared laser radiation. Alternately, when the photosensitive element forms an assemblage with the support carrying the infrared-sensitive layer, the infrared-sensitive layer can be transferred from the support to the photosensitive layer by exposure to infrared laser radiation. The infrared-sensitive layer can be used alone or with other layers, e.g., ejection layer, heating layer, etc. The infrared-sensitive layer generally comprises an infrared-absorbing material, a radiation-opaque material, and an optional binder. Dark inorganic pigments, such as carbon black and graphite, generally function as both infrared-sensitive material and radiation-opaque material. The thickness of the infrared-sensitive layer should be in a range to optimize both sensitivity and opacity. Such infrared-sensitive photoablative or phototransferable layer can be employed in digital direct-to-plate image technology in which the exposure by laser radiation removes or transfers the infrared-sensitive layer to form an in-situ mask on the photosensitive element. Suitable infrared-sensitive compositions, elements, and their preparation are disclosed in U.S. Pat. Nos. 5,262,275; 5,719,009; 5,607,814; 5,506,086; 5,766,819; 5,840,463; and EP 0 741 330 A1. The photosensitive element of the present invention may further include a temporary coversheet on top of the uppermost layer of the photosensitive element.

In one embodiment, the photopolymerizable printing form can undergo several conventional steps as is well know to those skilled in the art to create a printing form having a relief surface suitable for printing, including imagewise exposure to actinic radiation and treating, prior to mounting on the base. Imagewise exposure can be conducted through a phototool or through an in-situ mask on or adjacent the photopolymerizable layer. Treating of the photopolymerizable printing element includes (1) "wet" development wherein the photopolymerizable layer is contacted with a suitable developer solution to washout unpolymerized areas and (2) "dry" development wherein the photosensitive element is heated to a development temperature which causes the unpolymerized areas of the photopolymerizable layer to melt or soften or flow and is wicked away by contact with an absorbent material. Dry development may also be called thermal development. In one embodiment in which that photopolymerizable printing cylinders or sleeves have been coated with an infrared sensitive layer, such processing usually comprise the steps of imagewise exposure of the infrared sensitive layer with laser radiation, overall exposure with actinic radiation of the photopolymerizable layer through the imaged infrared sensitive layer, and treating to form the relief surface. In another embodiment, the printing form includes at least one layer that can be laser engraved to form a surface suitable for relief printing. The layer of the printing form is capable of absorbing laser radiation such that those areas of the materials which are exposed to a laser beam of sufficient intensity become physically detached with sufficient resolution and relief depth to be suitable for printing applications. By "physically detached", it is meant that the material so exposed is either removed or is capable of being removed by any mechanical means such as by vacuum cleaning or washing or by directing a stream of gas across the surface to remove the loosened particles. Typically for flexographic printing applications, the laser engravable layer is a reinforced elastomeric layer.

What is claimed is:

1. A method for mounting a plurality of cylindrically-shaped printing forms onto a cylindrically-shaped base having an exterior surface and at least one opening for providing pressurized air to the exterior surface, the printing forms each having an alignment indicator and an interior surface, capable of being radially expanded by the pressurized air, and an axial length such that the sum of the axial lengths of the printing forms is less than or equal to an axial length of the base, the method comprising:

a) axially orienting the interior surface of a first printing form adjacent the exterior surface of the base by expanding the first printing form with the pressurized air sufficiently to float the first printing form on the base;

b) positioning the first printing form on the base to a first registration position by aligning the indicator on the first printing form to the base;

c) engaging the floating first printing form with at least one holding member that maintains the first printing form in the first registration position;

d) axially orienting the interior surface of a second printing form adjacent the exterior surface of the base by expanding the second printing form with the pressurized air sufficiently to float the second printing form on the base;

e) positioning the second printing form on the base to a second registration position by aligning the indicator on the second printing form to the base;

f) engaging the floating second printing form to maintain the second printing form in the second registration position; and g) removing the pressurized air from the exterior surface of the base to allow the first and second printing forms to contract and thereby cause the respective interior surface of each printing form to contact the exterior surface of the base while the holding members maintain each printing form in the particular registration position on the base.

2. The method of claim 1 wherein each positioning step is selected from the group consisting of positioning the printing form to an axial registration position relative to the axial length of the base; positioning the printing form to a circumferential registration position on the base; and a combination thereof.

3. The method of claim 1 wherein the base is selected from the group consisting of a print cylinder, an adapter, an adapter mounted onto a print cylinder, and an adapter mounted onto a press mandrel.

4. The method of claim 1 wherein the engaging of the floating second printing form is with at least one holding member.

5. The method of claim 1 wherein the at least one holding member contacts an exterior surface opposite the interior surface of the printing form.

6. The method of claim 1 wherein the holding member has a contacting member for contacting an exterior surface of the printing form opposite the interior surface of the printing form.

7. The method of claim 6 wherein the contacting member is selected from the group consisting of rollers, disks, projecting fingers, suction cups, shoes, flanges, clamps, probes, arcs, and rings.

8. The method of claim 1 wherein two or more holding members engaging the printing form contact an exterior surface opposite the interior surface of the printing form.

9. The method of claim 8 wherein the two or more holding members are spaced at an axial distance apart on the printing form.

10. The method of claim 8 wherein the two or more holding members are spaced at a circumferential distance apart about the printing form.

11. The method of claim 8 wherein the two or more holding members are spaced circumferentially equidistant apart about the printing form.

12. The method of claim 1 wherein the printing forms are selected from the group consisting of relief printing forms and gravure printing forms.

13. The method of claim 1 wherein the printing forms are selected from the group consisting of relief printing forms made of rubber, photopolymerizable printing form precursors, elastomeric relief printing forms, and polymeric relief printing forms.

14. The method of claim 1 wherein the printing forms are selected from the group consisting of plates on sleeves, and continuous printing forms.

15. The method of claim 1 wherein the positioning of the printing form is selected from the group consisting of axially moving the printing form on the base, rotationally moving the printing form about the base, and combinations thereof.

16. The method of claim 1 wherein the positioning of the printing form is selected from the group consisting of rotating the base, axially moving the base, and combinations thereof.

17. The method of claim 1 wherein the orienting step further comprises contacting the printing form with a push sleeve to axially move the printing form.

* * * * *